United States Patent [19]

Mowry

[11] 4,203,256

[45] May 20, 1980

[54] STORM WINDOW ASSEMBLY

[76] Inventor: Dale A. Mowry, 166 R. E. Maple St., Clyde, Ohio 43410

[21] Appl. No.: 949,699

[22] Filed: Oct. 10, 1978

Related U.S. Application Data

[63] Continuation-in-part of Ser. No. 831,181, Sep. 7, 1977, abandoned.

[51] Int. Cl.[2] ..... E05C 21/02

[52] U.S. Cl. ..... 49/465; 49/62

[58] Field of Search ..... 49/463, 465, 57, 62, 49/61, 170

[56] References Cited

U.S. PATENT DOCUMENTS

| | | | |
|---|---|---|---|
| 2,697,389 | 12/1954 | Heckman | 49/465 |
| 2,777,174 | 1/1957 | Carr | 49/61 X |
| 3,349,517 | 10/1967 | Johnson | 49/61 |
| 3,745,957 | 7/1973 | Hendrickson et al. | 49/170 X |

*Primary Examiner*—Kenneth Downey

[57] ABSTRACT

A storm window assembly particularly adapted for placement adjacent the existing window frame and secured without the necessity of any bracketry permanently secured to the frame.

6 Claims, 13 Drawing Figures

STORM WINDOW ASSEMBLY

CROSS REFERENCE TO RELATED APPLICATION

This application is a continuation-in-part of United States Patent Application Ser. No. 831,181, filed Sept. 7, 1977 in the name of the inventor hereof and entitled "STORM WINDOW ASSEMBLY now abandoned."

BRIEF SUMMARY OF THE INVENTION

Windows play an important role in conserving home heating and cooling fuels. Even with good windows, a great deal of fuel is wasted. Almost three times as much heat is lost directly through the window glass as from the edges of the frame. One square foot of single glazing looses as much heat as ten square feet of solid wall.

If the walls of a statistically average house consisted of 15% windows, more than 60% of the energy lost through the house's total outside walls would be through the glass of the windows therein.

The average homeowner is somehow convinced from existing publicity that there is a greater need to insulate the existing walls at great expense and inconvenience than to install storm windows, which is quicker, easier, and relatively inexpensive.

A storm window helps reduce infiltration of air, but its primary function is to provide a second layer of glass, reducing by 50% or more the amount of heat loss through a single glass.

Even tight fitting, draft-free windows need storm windows. The greatest amount of heat loss is directly through the single glass.

It is an objective of the invention to produce a storm window assembly which may be readily and economically manufactured.

Another object of the invention is to produce a storm window assembly which may be assembled and installed by nonprofessional persons.

Another object of the invention is to produce a storm window assembly which may be readily installed in existing window frames or openings without any special structural preparation thereof.

Still another object of the invention is to produce a storm window assembly which may be installed and removed for storage or cleaning without leaving any marring or other disfigurement of the existing window opening or frame work.

The above, as well as other objects and advantages of the invention, may be readily achieved by a storm window assembly for attachment to a window opening frame comprising a planar sheet of transparent material; cooperating window opening frame engaging means including at least one arm having one end extending outwardly toward a marginal edge of the planar sheet and adapted to frictionally engage a planar portion of the window opening frame; means for pivotally mounting the other end of said cooperating window opening frame engaging means to said planar sheet of transparent material including at least one upstanding mounting brace; and means for imparting movement of the one end of the arm of the engaging means relative to the one surface of the planar sheet and the arm so as to cause the one end of the arm to frictionally engage a planar portion of the window opening frame.

BRIEF DESCRIPTION OF THE DRAWINGS

The objects and advantages of the invention will become readily apparent to one skilled in the art from reading the following detailed description of an embodiment of the invention when considered in the light of the attached drawings in which.

DETAILED DESCRIPTION OF PREFERRED EMBODIMENT OF THE INVENTION

Figure 1:
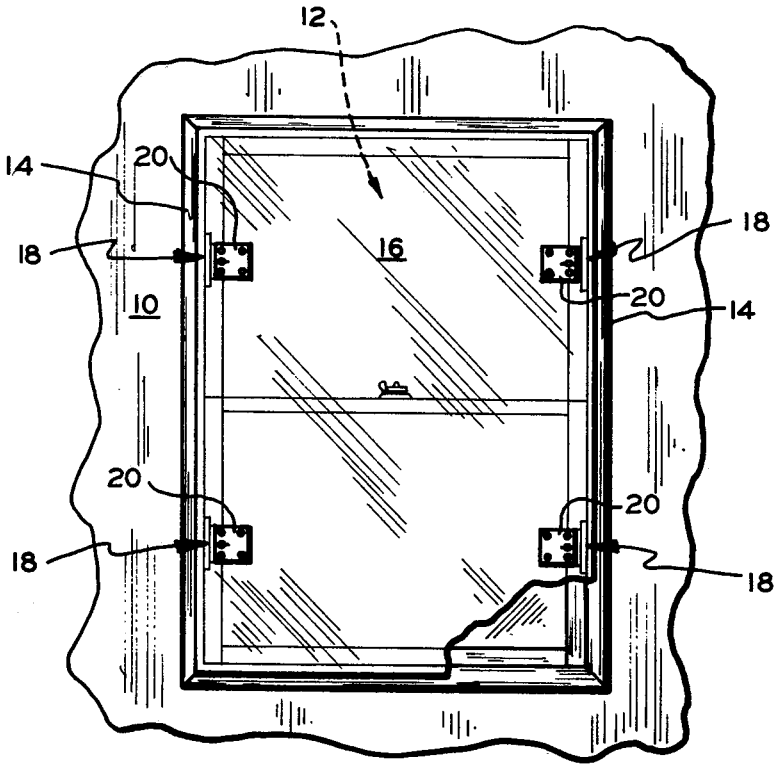
FIG. 1 is a fragmentary front elevational view of a storm window assembly constructed in accordance with the invention in an operational position in a window opening as viewed from the inside of the associated building.
Figure 2:
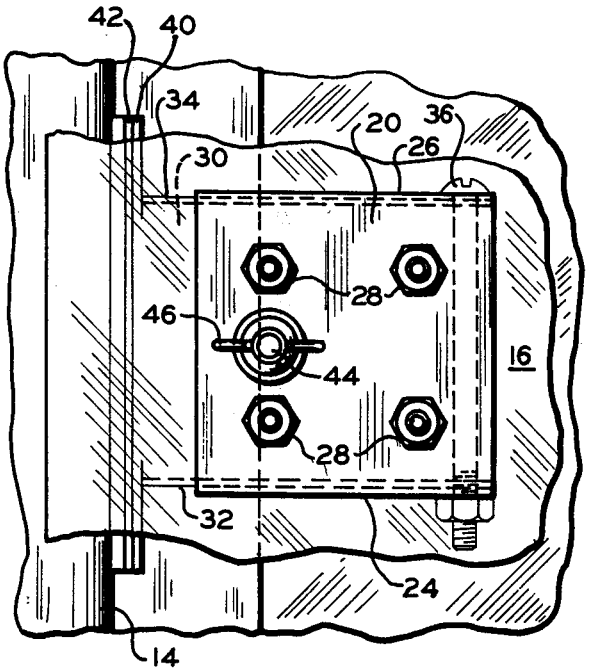
FIG. 2 is an enlarged fragmentary elevational view of one of the mounting brackets illustrated in FIG. 1.
Figure 3:
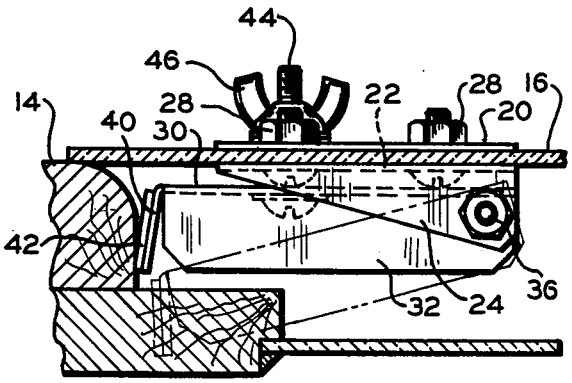
FIG. 3 is a side view of the mounting bracket illustrated in FIG. 2.

Referring initially to the embodiment of the invention illustrated in FIGS. 1, 2 and 3, there is shown a portion of the inside wall 10 of a building such as a residence, for example, containing a window opening having a typical double-hung window structure 12 positioned therein. The window structure 12 typically includes a suitable frame 14 having horizontal and vertical frame members with their end portions being mitered to form attractive and structurally sound corners. In many instances, the double hung window structures are formed of wood and therefore care must be taken to not mar or scratch the surfaces thereof.

A planar sheet 16 of transparent material such as an acrylic resinous substance, glass, or other transparent materials is adapted to be placed and maintained in slightly spaced relation from the glass panels of the window 12 by means of a series of pressure brackets 18. The dimensions of the planar sheet 16 are such that the marginal edges thereof intimately contact the exposed inner surface of the frame 14, and is clearly illustrated in FIG. 3. The window 12 of FIG. 1 has no sill portion which projects outwardly away from the window and accordingly the marginal edges of the planar sheet 16 form a seal completely around the window due to the fact that the inner surface of the marginal edge of the sheet 16 contacts the frame members 14 around the entire window. It will be understood that in certain instances the window will include a sill which projects away from the wall 10 a distance further than the frame members 14. In such instances, the bottom of the planar sheet 16 will rest upon the upper horizontal surface of the sill while the other edge portions will make contact with the frame members 14 as illustrated.

In each instance, however, pressure brackets 18 are secured to the sheet 16. In the illustrated embodiment, the pressure brackets 18 include a base support plate 20 typically positioned on the surface of the sheet 16 which faces toward the interior of the building. A cooperating mounting bracket having a flat base portion 22 and a pair of spaced apart upstanding marginal edge portions 24 and 26 is positioned on the opposite surface of the sheet 16 in alignment with the base support plate 20. The sheet 16, base support plate 20, and the base portion 22 of the mounting bracket are provided with alignable apertures which receive threaded fasteners 28 for suitably securing the brackets 18 to the sheet 16.

A pressure arm 30 having upturned edge portions 32 and 34 has one end pivotally secured to the mounting bracket by a threaded fastener 36 which is adapted to be received in preformed holes in the marginal edge portions 24, 26, 32, and 34. The opposite end of the arm 30 is provided with an angularly disposed upturned end portion 40 having a strip 42 of resilient material formed of felt, for example, to militate against marring or scratching of the exposed surface of the frame 14 when the assembly is in its operational position.

Movement of the end 40 of the arm 30 about the fastener 36 is effected by a threaded shank 44 and an associated wing nut 46. The head of the threaded shank 44 is disposed on the side of the mounting bracket facing the interior surface of the window 12. The threaded shank 44 extends through suitably aligned holes formed in the support plate 20, the sheet 16, and the base portion 22 of the mounting bracket. Washer elements may be used if deemed necessary to facilitate the operation. It will be observed, from viewing FIG. 3 that by tightening the wing nut 46 on the threaded shank 44, the arm 30 may be swung from the position illustrated in phantom lines to the full line position wherein the felt strip 42 of the end 40 of the arm 30 is in wedging contact with the frame 14.

It will be understood that the storm window assembly of the invention may be easily mounted in insulating relation to an existing window 12 by placing the assembly described above within the window opening and subsequently tightening the wing nuts 46 of each of the pressure brackets 18 until the ends 40 carrying the felt strip 42 abut the adjacent window frame number 14. In effect, the pressure bracket assemblies 18 on one marginal edge of the sheet 16 cooperate with their counter parts on the opposite marginal edge portion to effectively wedge against the window frame members 14 to maintain the sheet 16 in the desired position.

At the end of the heating season, the assemblies may be easily removed by reversing the mounting operation above, and then stored. However, in the event the building is air conditioned to maintain a cooled condition within the building during the warm months of the year, it will be advantageous from an energy standpoint, to allow the assembly to remain in situ the entire year, removing only periodically for cleaning purposes.

While suitable results have been achieved by forming the pressure bracket assemblies 18 from sheet metal stock, it is understood that equally satisfactory results can be achieved by forming the same from precast parts of plastic, or other suitable materials.

Figure 4:
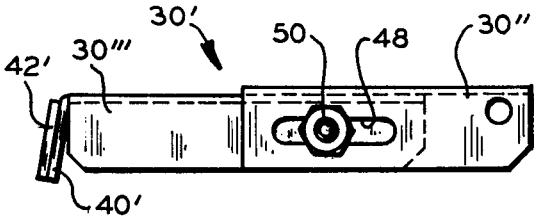
FIG. 4 is a side view of a modified form of the window frame engaging arm wherein the arm body is extendable.

In order to provide a storm window assembly which will be accommodated by a range of window dimensions, the modification of the invention illustrated in FIG. 4 is deemed useful. The FIG. 4 modification utilizes an extendable pressure arm 30' wherein the one end portion 30'' which is pivotally mounted to an associated mounting bracket has an elongate slot 48 formed therein. The other portion 30''' of the arm 30' which contains the end 40' carrying the felt strip 42' has a hole aligned with the slot 48 for receiving a threaded fastener 50. It will be readily apparent that the pressure arm 30' may be readily elongated by loosening the threaded fasteners 50 and allowing the arm portion 30''' to be extended to the full extent of the slot 48. Once the portion 30''' has been extended with respect to the portion 30'', the fastener 50 is tightened and the assembly is ready for mounting.

Figure 5:
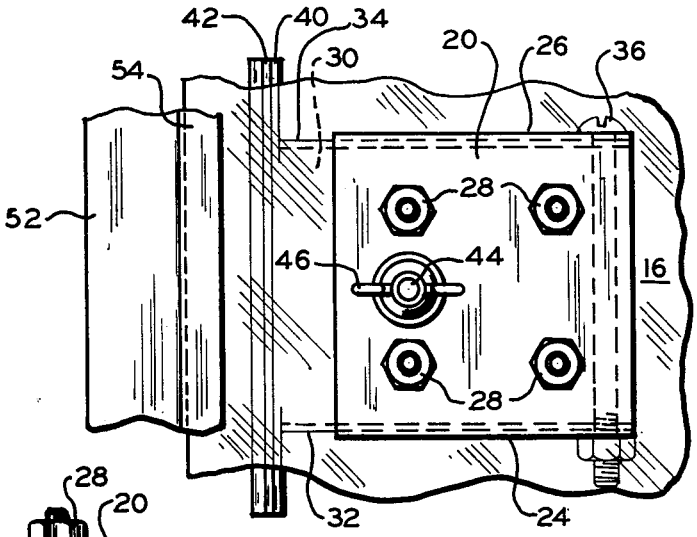
FIG. 5 is a fragmentary elevational view of a storm window assembly of the general type illustrated in FIG. 2 showing the utilization of an air sealing gasket member adapted to fit on the peripheral marginal edge of the transparent planar sheet of material of the assembly.
Figure 6:
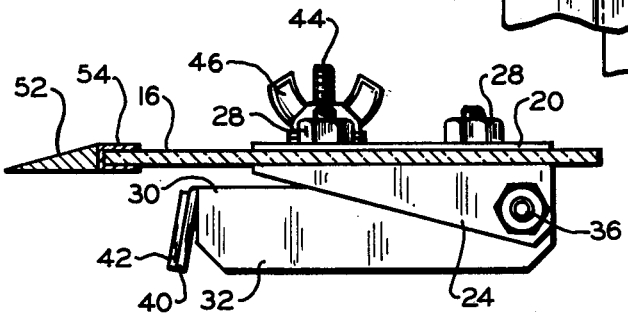
FIG. 6 is a side view of the arrangement illustrated in FIG. 5.

FIGS. 5 and 6 show the arrangement illustrated in FIGS. 1, 2 and 3 wherein an additional sealing strip is employed around the peripheral edge of the sheet 16 to aid in effecting an air-tight seal between the sheet 16 and window frame members 14. A sealing strip 52 formed of an elastomeric material is to be tapered in cross-section. The strip 52 has a generally U-shaped channel portion 54 which is adapted to receive the marginal edge portion of the sheet 16.

Figure 7:
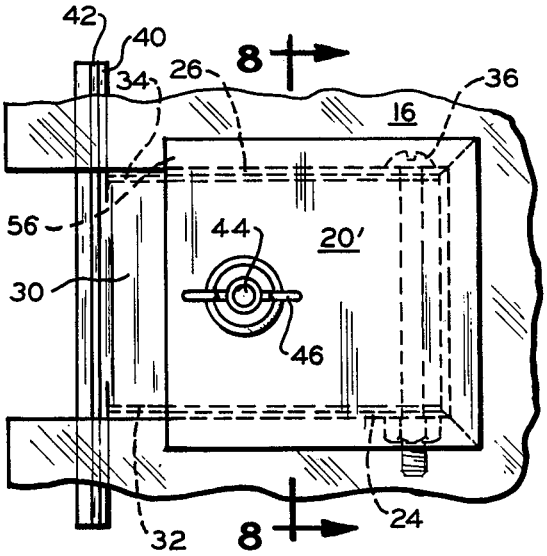
FIG. 7 is a fragmentary view similar to the views of FIGS. 2 and 5 showing another embodiment of the invention wherein the mounting bracket of the invention is mounted within a cut-out area in the region of the marginal edge portion of the transparent planar sheet material.
Figure 8:
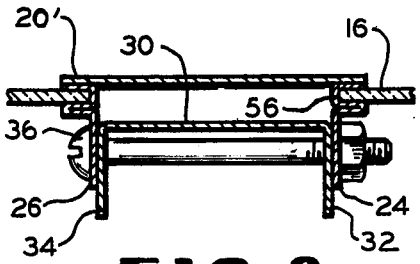
FIG. 8 is a sectional view of the embodiment illustrated in FIG. 7 taken along line 8—8 thereof.

FIGS. 7 and 8 show another embodiment of the invention wherein rather than predrilling the transparent sheet 16 to provide holes for receiving threaded fasteners for maintaining the mounting bracket, rectangular sections of the sheet are removed from the marginal edges and a modified form of the brackets are slipped on and held thereon by a press-fit. More particularly, the modification includes a base support plate 20' having the marginal edge portions formed to provide an outwardly opening channel 56 to receive the edges of the cut-out portion of the sheet 16. In other respects, the structure is the same as that illustrated in FIGS. 1, 2, and 3.

Figure 9:
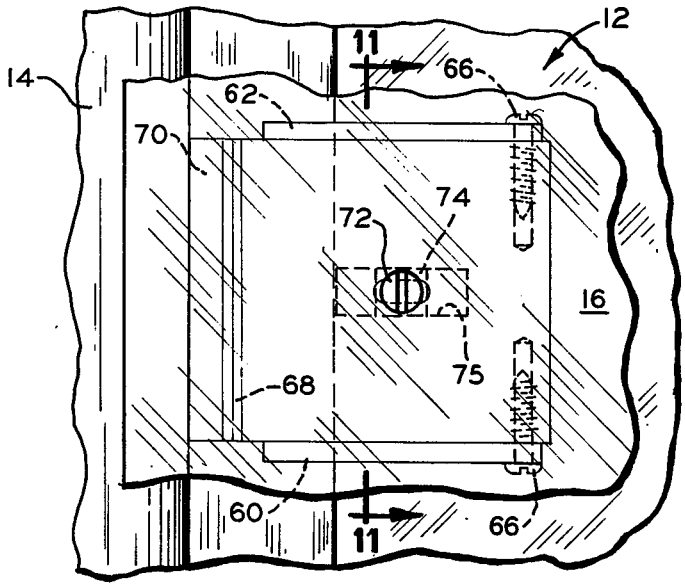
FIG. 9 is a fragmentary elevational view similar to FIGS. 2, 5, and 7 showing another embodiment of the invention wherein the mounting bracket is adhesively secured to the transparent planar sheet material.
Figure 10:
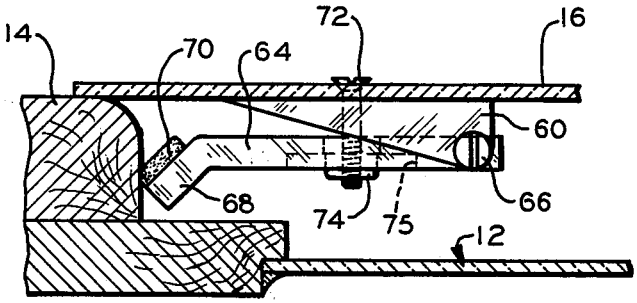
FIG. 10 is a side view of the arrangement illustrated in FIG. 9.
Figure 11:
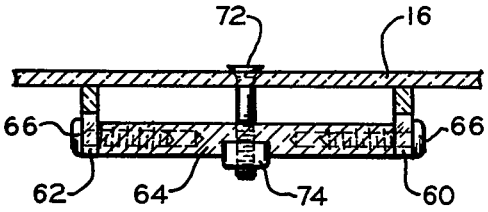
FIG. 11 is a sectional view of the embodiment illustrated in FIG. 9 taken along line 11—11 thereof.

FIGS. 9, 10, and 11 illustrate another embodiment of the invention wherein a pair of upstanding mounting braces 60 and 62 are secured directly to the transparent sheet 16. Any suitable adhesive, thermal or other bonding method can achieve satisfactory results. A pressure arm 64 has one end pivotally secured to each of the mounting braces 60 and 62 by a threaded fastener 66. The opposite end of the pressure arm 64 is provided with an angularly disposed end portion 68 having a strip 70 of resilient material formed of felt, for example, to militate against moving or scratching of the exposed surface of the frame 14 when the assembly is in its operational position. Satisfactory results have been achieved by forming the mounting braces 60 and 62 and the pressure 64 from sheet metal stock or other suitable material. However, the most desirable results have been obtained by forming the same of transparent rigid plastic material which is indistinct and aesthetically pleasing against the transparent sheet 16. Such material is also easily drilled to provide holes for receiving the threaded fasteners 66 for maintaining the mounting braces 60 and 62.

Movement of the end portion 68 of the pressure arm 64 about the pair of fasteners 66 is effected by a threaded shank 72 and an associated receiving nut 74. The head of the threaded shank 72 is disposed on the side of the transparent sheet 16 facing the interior of the building and extends therethrough into a suitably aligned slot formed in the pressure arm 64 and into threaded engagement with the receiving nut 74. In the illustrated embodiment, the receiving nut 74 is secured in an appropriately sized depression 75 in the pressure arm 64 so as to prevent the nut 74 from turning when the threaded shank 72 is rotated to adjust the position of the pressure arm 64 but also allow for longitudinal movement of the nut 74 as the angle at which the pressure arm is disposed is varied. It will be appreciated from viewing FIG. 10 that by rotating the threaded shank 72, the pressure arm 64 may be swung to a position such that the arm 64 is frictionally engaged to a planar portion of the frame 14.

Figure 12:
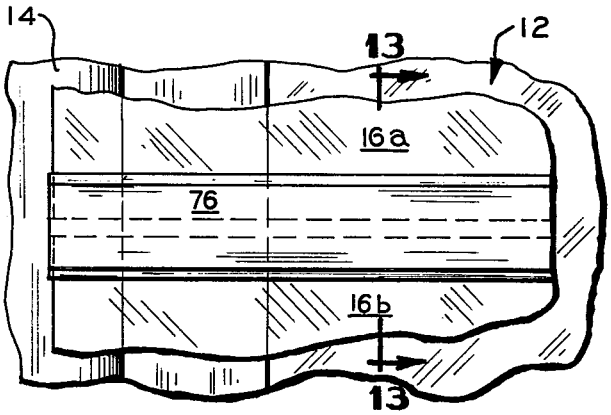
FIG. 12 is a fragmentary elevational view similar to the views of FIGS. 2, 5, 7, and 9 showing a self sealing stabilizing bar for double hung windows.
Figure 13:
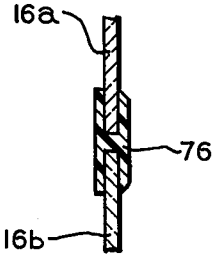
FIG. 13 is a sectional view of the arrangement illustrated in FIG. 12 taken along line 13—13 thereof.

FIGS. 12 and 13 illustrate a self-sealing stabilizing bar 76. The bar 76, includes a pair of outwardly opening channels on opposite marginal edges thereof for suitably receiving a pair of planar sheets 16*a* and 16*b* in air sealing relation therewith.

It will be appreciated from the above description that the invention provides a storm window assembly which will stop air flow and thereby materially reduce heat loss through portions of existing buildings which notoriously are extremely inefficient from an energy conservation standpoint. The storm window assembly of the invention may be used with existing window frame structures without modifying the frame structures. The assembly requires no auxiliary hardware and can be installed and removed without marring or scratching the existing structures.

In accordance with the provisions of the patent statutes, I have explained the principle and mode of operation of my invention and have illustrated and described what I now consider to represent its best embodiment. However, it must be understood that within the spirit and scope of the appended claims, the invention may be practiced otherwise than as specifically illustrated and described.

What I claim is:

1. A storm window assembly for attachment to a window opening frame comprising:

a planar sheet of transparent material;

cooperating window opening frame engaging means including at least one arm having one end extending outwardly toward a marginal edge of said planar sheet and adapted to frictionally engage a planar portion of the window opening frame;

means for pivotally mounting the other end of said cooperating window opening frame engaging means to said planar sheet of transparent material including at least one upstanding mounting brace; and means for imparting movement of the one end of the arm of said engaging means relative to the one surface of said planar sheet including a threaded shank extending through said planar sheet and the arm so as to cause the one end of the arm to frictionally engage a planar portion of the window opening frame.

2. The invention defined in claim 1 wherein said means for pivotally mounting the other end of said cooperating window opening frame engaging means to said planar sheet of transparent material includes a plate provided with at least one upstanding mounting brace.

3. The invention defined in claim 2 wherein said plate is provided with a pair of spaced apart upstanding marginal edge mounting braces to militate against any lateral movement of the arm of said frame engaging means.

4. The invention defined in claim 3 wherein the arm of same frame engaging means includes spaced apart upstanding marginal edge portions.

5. The invention defined in claim 1 wherein the arm of said frame engaging means is extendable.

6. The invention defined in claim 2 wherein said plate means includes an outwardly opening channel along at least a portion of the marginal edge thereof to receive a suitably formed portion of said planar sheet in air sealing relation therewith.

* * * * *